US007175131B2

(12) United States Patent
Dodu et al.

(10) Patent No.: US 7,175,131 B2
(45) Date of Patent: Feb. 13, 2007

(54) DEPLOYMENT AND DRIVE DEVICE FOR PROJECTILE CONTROL SURFACES

(75) Inventors: René Dodu, Bourges (FR); Dominique Dion, Bourges (FR)

(73) Assignee: Giat Industries, Versailles (FR)

( * ) Notice: Subject to any disclaimer, the term of this patent is extended or adjusted under 35 U.S.C. 154(b) by 65 days.

(21) Appl. No.: 11/009,090

(22) Filed: Dec. 13, 2004

(65) Prior Publication Data

US 2005/0151000 A1 Jul. 14, 2005

(30) Foreign Application Priority Data

Dec. 31, 2003 (FR) ..... 03 15601

(51) Int. Cl.
*F42B 10/00* (2006.01)
*F42B 15/01* (2006.01)

(52) U.S. Cl. ..... 244/3.24; 244/3.1; 244/34 R; 244/99.2

(58) Field of Classification Search ..... 244/3.24–3.3, 244/49, 99.2, 99.3, 34 R, 38, 39, 213, 3.25, 244/3.26, 3.28; 102/374, 384, 385, 501, 102/503
See application file for complete search history.

(56) References Cited

U.S. PATENT DOCUMENTS 4,175,720 A * 11/1979 Craig ..... 244/3.28
4,709,877 A * 12/1987 Goulding ..... 244/3.28
5,114,095 A * 5/1992 Schroppel et al. ..... 244/3.28
6,073,880 A * 6/2000 Voigt et al. ..... 244/3.28
6,186,443 B1 * 2/2001 Shaffer ..... 244/49
6,446,906 B1 9/2002 Voigt et al. ..... 244/3.27

FOREIGN PATENT DOCUMENTS

WO WO 02/18867 3/2002

* cited by examiner

*Primary Examiner*—Teri Pham Luu
*Assistant Examiner*—Joshua Michener
(74) *Attorney, Agent, or Firm*—Steptoe & Johnson LLP

(57) ABSTRACT

A deployment and orientation device for projectile control surfaces, the deployment being carried out by means of springs between a loading position in which the control surfaces are folded inside the projectile and held against the action of the spring means using blocking means, and a deployed position in which the control surfaces may be oriented with respect to the projectile, device wherein it incorporates motors ensuring firstly the deployment of the control surfaces and secondly their orientation, the blocking means for the control surfaces being single means ensuring the immobilization of all the control surface and enabling them to be released simultaneously, the blocking means being immobilized by first locking means released by the pivoting of the bodies of the motors.

9 Claims, 5 Drawing Sheets

DEPLOYMENT AND DRIVE DEVICE FOR PROJECTILE CONTROL SURFACES

BACKGROUND OF THE INVENTION

1. Field of Invention

The technical scope of the present invention is that of deployment and drive devices for projectile fins, and in particular for control surfaces, i.e. fins able to pivot when in the deployed position, under the action of a piloting motor.

2. Description of Related Art

Control surfaces play a role in the piloting of a projectile but may also have a role to play in its stabilization, similarly to the control surfaces of a plane, since they are controlled in rotation by a motor piloted by an electronic system. The piloting of the projectile enables its trajectory to be corrected in flight thus compensating for any errors made in laying or orienting the projectile on a target after detecting such a target.

The main disadvantage of such control surfaces lies in that, to be effective, they must have large dimensions (the length of the control surface is usually around that of the calibre) thereby making it impossible to fire the projectile from a weapon of this calibre. Thus, over the past years, different fin and control surface deployment mechanisms have been developed for projectiles ranging from missiles, to rockets, or sub-projectiles on-board a large calibre spin-stabilized carrier shell. These mechanisms however remain cumbersome and heavy, thereby reducing the projectile's payload.

Projectiles are thus sought to be equipped with control surface deployment and orientation devices.

Thus, U.S. Pat. No. 6,446,906 describes a device to unblock and orient control surfaces, said orientation being ensured by two motors each acting on a pair of control surfaces.

Such a solution suffers from an incontestable drawback however. Indeed, the control surfaces are released by means of a pyrotechnic device, which, on the one hand takes up a certain volume thereby further reducing the payload able to be carried by the projectile, and on the other leaves a risk of accidental deployment of the control surfaces, namely during the handling phases of the projectile.

U.S. Pat. No. 6,186,443 also describes a deployment and drive device for the wing of an aircraft. Such a device is only adapted, however, to the deployment of one wing and not to the simultaneous deployment of several control surfaces. It may therefore not be adapted to projectiles without further reducing the space given over to the payload.

Patent application WO-02/18867 describes a control surface deployment device. This document namely proposes a device for the simultaneous deployment of control surfaces and then an individual orientation mechanism for each control surface, once again increasing the volume of the device.

SUMMARY OF THE INVENTION

The aim of the present invention is to supply a projectile control surface deployment and orientation device which ensures the simultaneous deployment of the control surfaces, said device being secure, light and taking up little space, and requiring little energy.

The invention thus relates to a deployment and orientation device for projectile control surfaces, the deployment being carried out by means of springs between a loading position in which the control surfaces are folded inside the projectile and held against the action of the spring means using blocking means, and a deployed position in which the control surfaces may be oriented with respect to the projectile, device wherein it incorporates motors ensuring firstly the deployment of the control surfaces and secondly their orientation, the blocking means for the control surfaces being single means ensuring the immobilization of all the control surfaces and enabling them to be released simultaneously, the blocking means being immobilized by first locking means released by the pivoting of the motor bodies around bearings.

According to one characteristic of the invention, the first locking means immobilizing the single blocking means are constituted by fingers each activated by a spring and cooperating with a ring integral with the body of each motor.

According to another characteristic of the invention, the ring has a notch inside which the end of the finger penetrates, this displacement of the finger thus releasing the blocking means and furthermore ensuring the immobilization in rotation of the motor body.

According to yet another characteristic of the invention, the control surfaces are integral, two by two, with a same control shaft placed transversally with respect to the projectile, each shaft being driven in rotation by a motor.

According to another characteristic of the invention, the motor drives the control shaft by means of a lever acting on a rod connected to the shaft.

According to another characteristic, each control surface is integral with the control shaft by means of a support and with an arm articulated with respect to said support.

According to another characteristic, the arm is subject to the action of a spring to ensure the rotation of the control surface with respect to the support.

According to another characteristic, the device incorporates second locking means which lock the control surfaces and the support in a deployed position.

According to another characteristic, the second locking means are formed of a pin positioned in a drill hole in the eleven so as to make the control surface integral with the support.

A first advantage of the device according to the invention lies in the fact that, contrary to present-day systems, the invention only uses two motors for the deployment and control of the control surfaces, thereby enabling a reduction in manufacturing costs, in the electrical energy needs of the system, and in volume.

Another advantage lies in the fact that the control surfaces are deployed simultaneously. In this way, the risk of destabilizing the projectile is considerably reduced.

Another advantage lies in the fact that the control surfaces may only be deployed after having been unblocked, thereby reducing the risk of accidental injury or damage during the handling of projectiles thus equipped.

BRIEF DESCRIPTION OF THE DRAWINGS

Other characteristics, particulars and advantages of the invention will become more apparent from the description given hereafter by way of illustration and in reference to the drawings, in which:

FIGS. 1*a* and 2*b* are perspective views of a device according to the invention, respectively with and without the element support seat.

DETAILED DESCRIPTION OF PREFERRED EMBODIMENTS

Figure 1A:
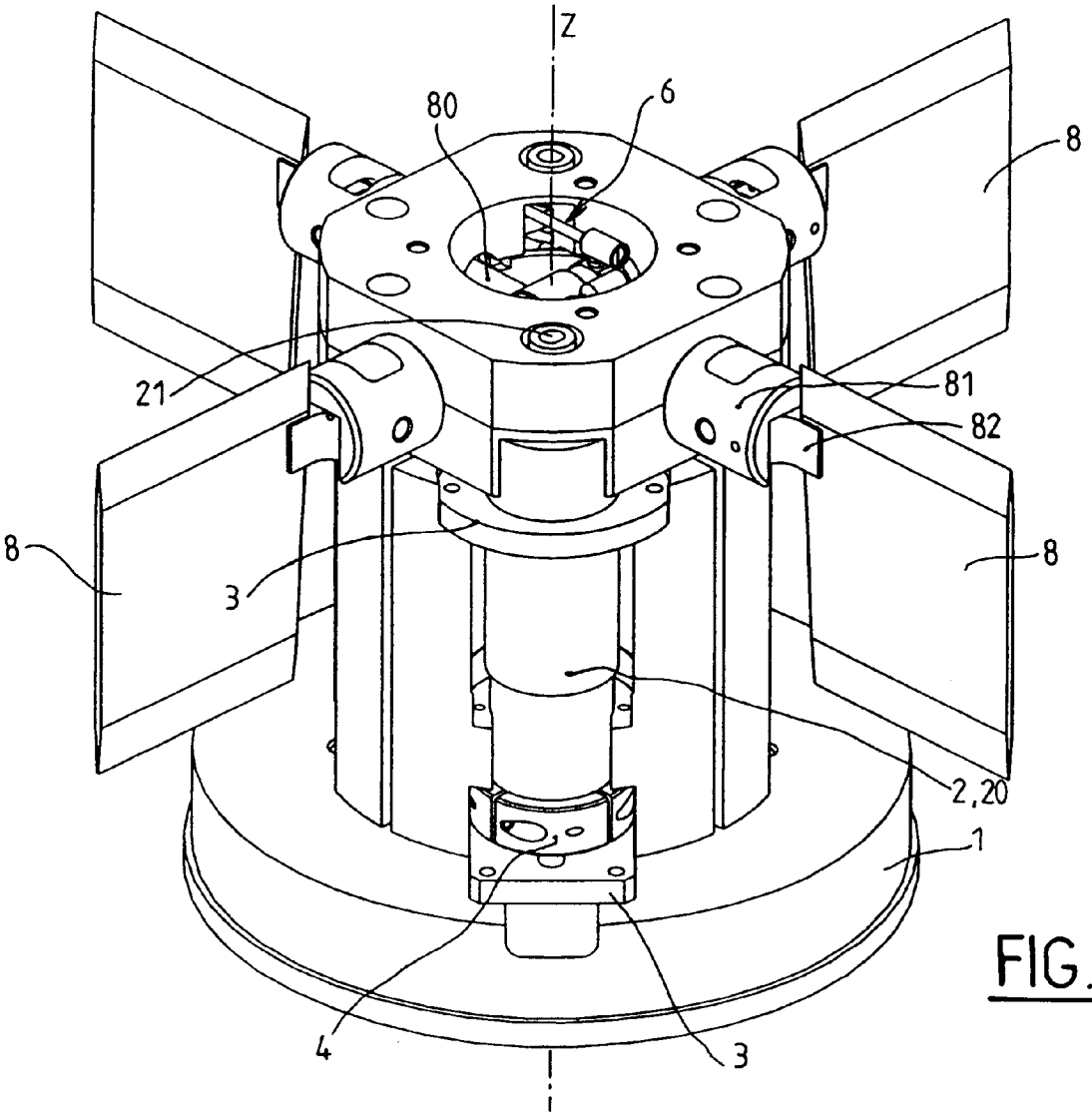
Figure 1B:
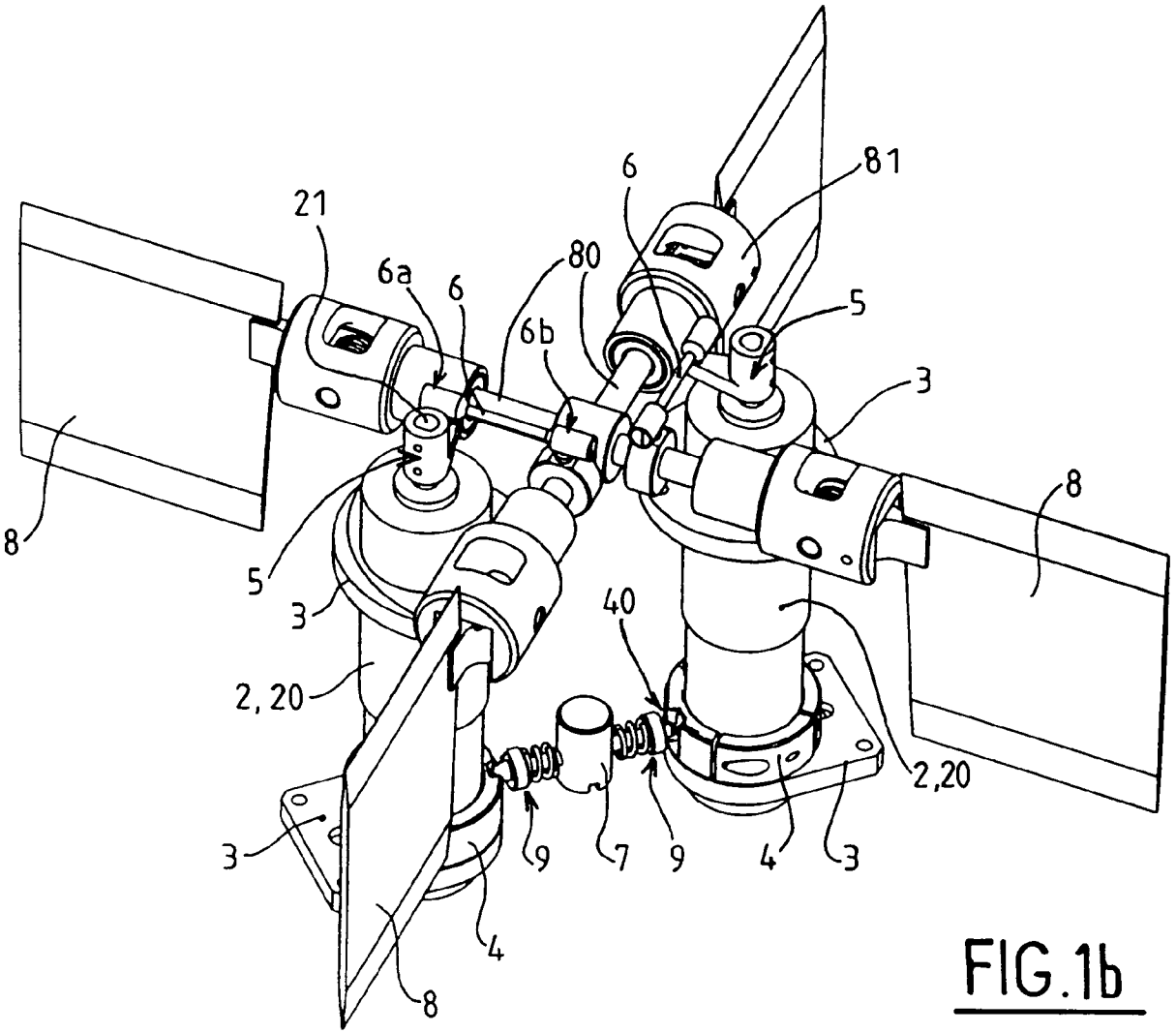

FIGS. 1*a* and 1*b* are perspective views of a deployment and drive device for the control surfaces of a projectile, according to the invention. These views show the device in its locked position, after deployment of the control surfaces. In view 1*b*, to improve clarity, only the essential elements have been illustrated.

The device according to the invention incorporates a seat 1 substantially shaped by revolution, supporting the whole device and integral with the projectile (not shown) equipped with said device, two motors 2 (only one of which may be seen in the FIG. 1*a*) supported by bearings 3 and arranged symmetrically with respect to axis Z of the seat, control surfaces 8, single blocking means 7 for the control surfaces, locking fingers 9, and shafts 80 provided at their ends with control surface supports 81, thus each supposing two facing control surfaces.

In the Figures, the two shafts 80 are arranged perpendicularly to each other, but a different configuration may be provided without departing from the spirit of the invention. The use of perpendicular shafts to orient the control surfaces is sufficiently known to the Expert and thus requires no further description. Reference may, however, be made to patent U.S. Pat. No. 6,446,906 and to patent application FR-2846080 which detail such embodiments.

The motors 2 incorporate a body 20 and a shaft 21 mobile in rotation with respect to one another. A ring 4, provided with a notch 40 is integral with the body 20 of the motor. The shaft 21 of the motor 2 has a lever 5 at its end that acts on the shaft 80 by means of a rod 6.

Figure 2:
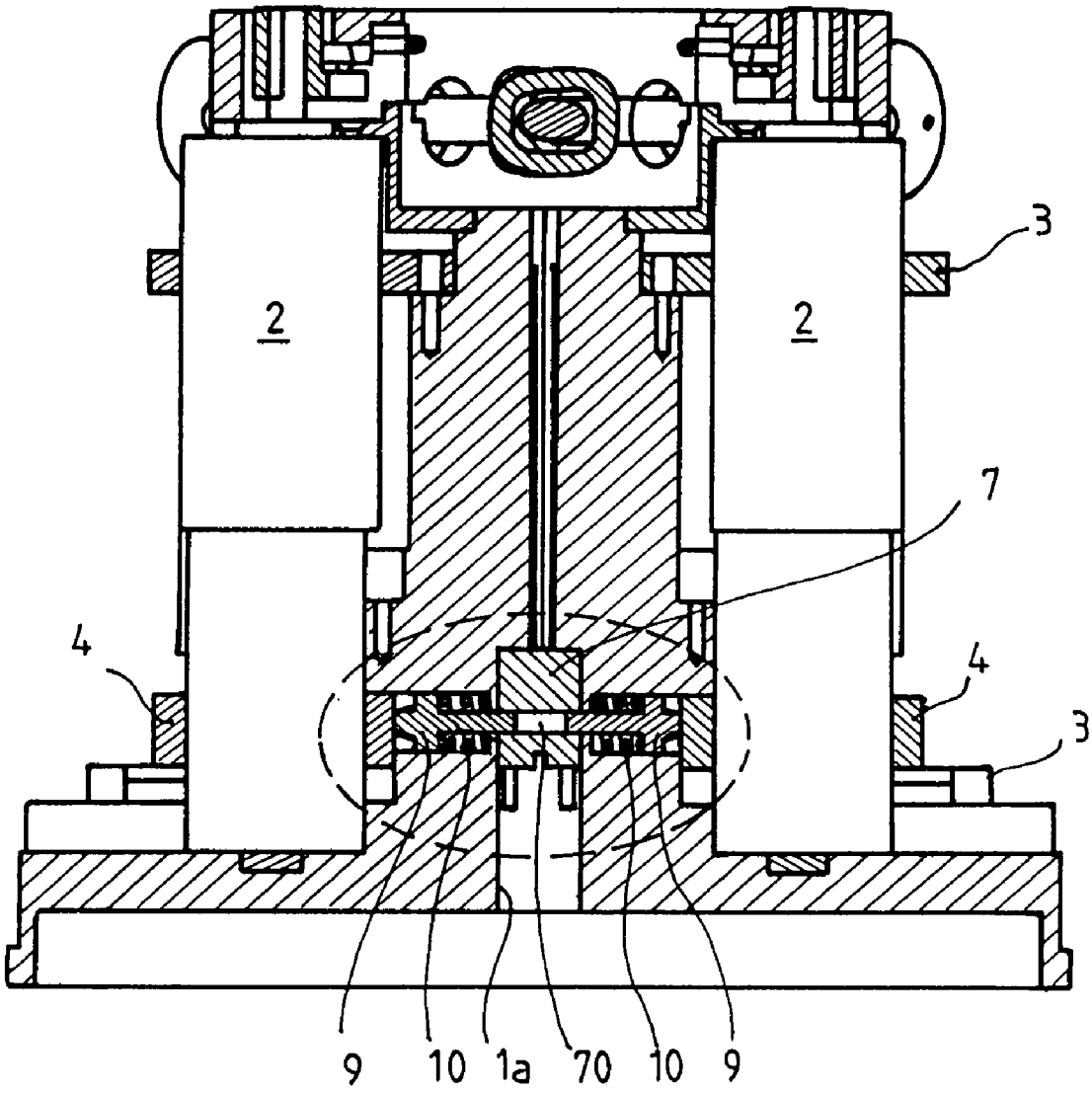
FIGS. 2, 3 and 4 are section views showing the blocking and deblocking mode of the control surfaces in their folded position.
Figure 3:
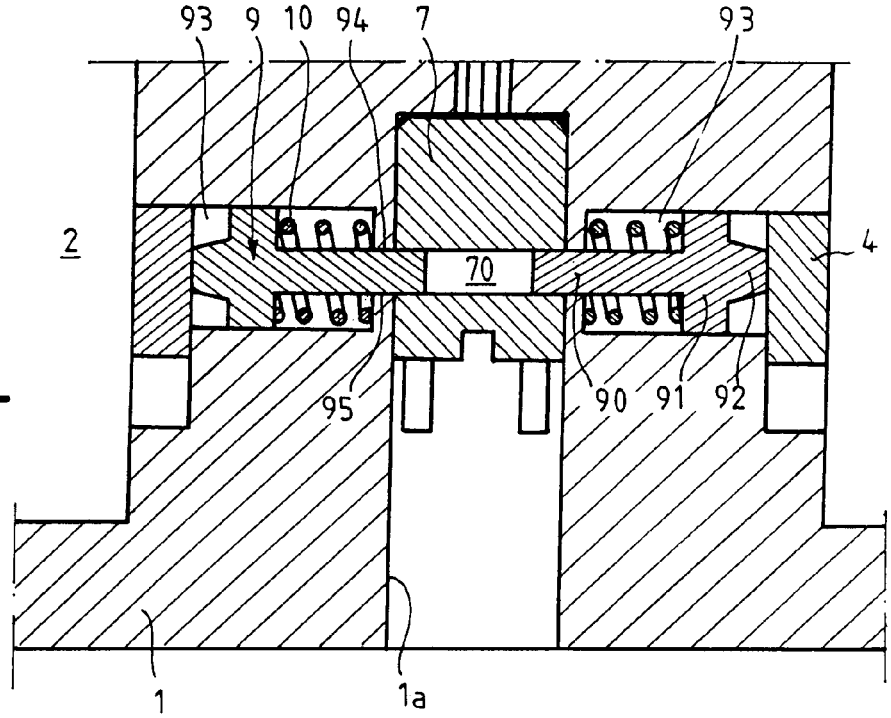
Figure 4:
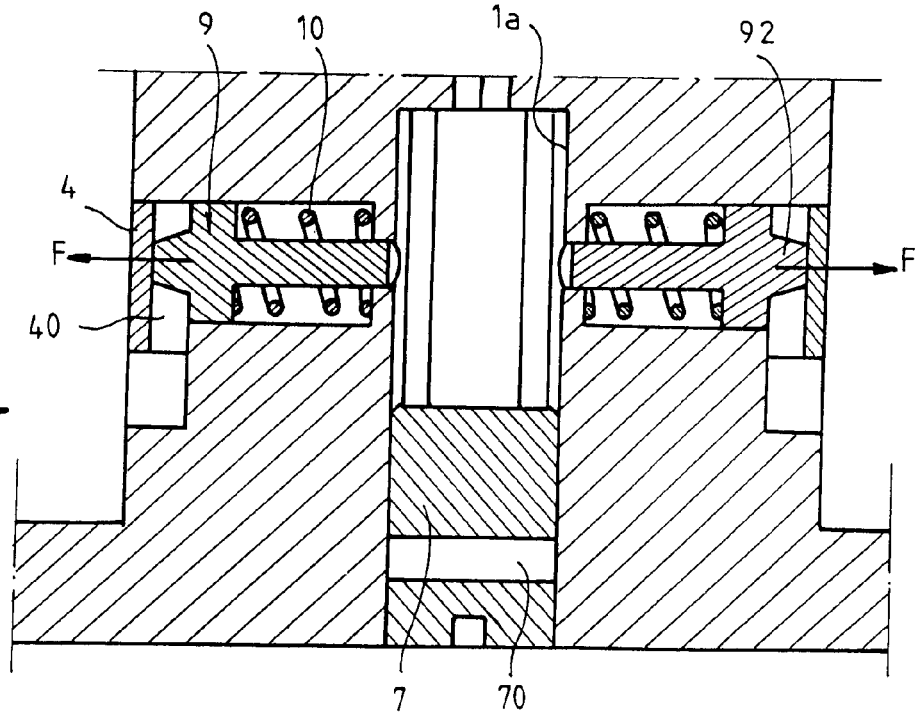

FIGS. 2 to 4 are section views of one embodiment of the deployment and drive device for projectile control surfaces. FIG. 2 shows the device in the position in which the control surfaces are locked into their folded position.

The control surfaces 8 (not shown in this Figure) are held in the loading position in which they are folded inside the projectile by single blocking means 7. These blocking means are held in position by fingers 9 inserted into a drill hole 70 in the blocking means.

FIG. 3 is a partial section corresponding to the dashed boxed area in FIG. 2; it shows an embodiment of the locking mode for the control surfaces in their folded position.

The seat 1 incorporates two counter-sinks 93 in which the fingers 9 are able to translate. The inside end of the counter-sinks 93 (i.e. the end closest to the axis of symmetry of the seat 1) does not open out and incorporates a drill hole 94 of a diameter less than that of the counter-sink and opening opposite the drill hole 70 of the blocking means 7. The fingers 9 are shaped by revolution, with a T-shaped section, so as to have three parts: a cylindrical or tapered nipple 92, a piston 91 of a cylindrical shape and with a diameter that is slightly less than the diameter of the counter-sink 93 and a rod 90, cylindrical in shape and of a diameter slightly less than the diameters of drill holes 94 and 70. The rod 90 passes through drill hole 94 and is inserted into drill hole 70 of the blocking means 7 thereby holding it in position. A spring 10, placed between the piston 91 and the edge 95 of the counter-sink 93, exerts a load on finger 9 towards the outside of the seat in the aim of moving it away from the blocking means 7. The nipple 92 is thus held against the ring 4.

FIG. 4 shows the unlocking of the control surfaces from their folded position. In this view, the rings 4 have rotated until their notches 40 lie opposite the fingers 9. Under the action of the springs 10, the fingers 9 are displaced in direction F of the load created by the springs. The nipples 92 are inserted in their respective notches 40 and the rod 90 comes out of drill hole 70 thereby unlocking the blocking means 7. The control surfaces are thus deployed by pushing the blocking means 7 into its housing la in the seat 1.

Figure 5:
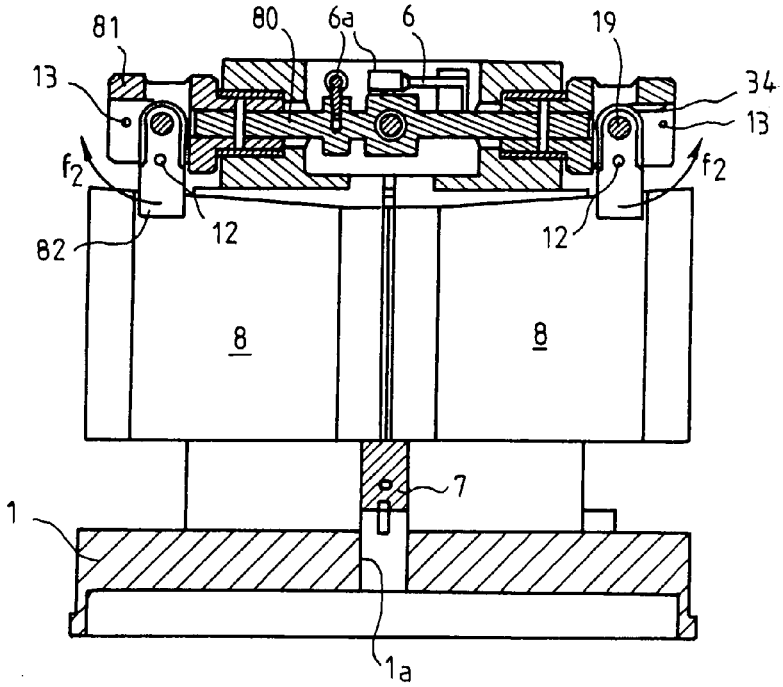
FIGS. 5 and 6 are view along another plane showing the deployment and drive modes of the control surfaces.
Figure 6:
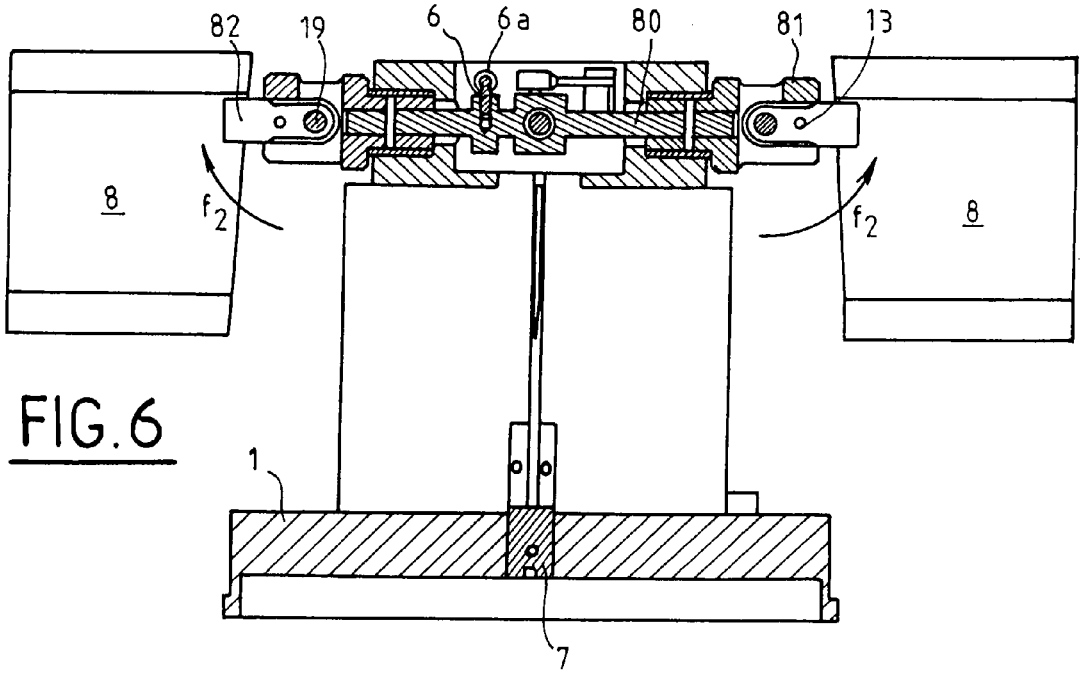

FIGS. 5 and 6 are section views showing the control surface deployment and drive devices. FIG. 5 shows a section view of the device when the control surfaces 8 are fully folded and FIG. 6 shows, on the same scale, the section view of the device when the control surfaces 8 are fully deployed.

In FIG. 5, the blocking means 7 hold the control surfaces 8 in the folded position against the action f2 of spring means 34 thereby preventing them from deploying.

In FIG. 6, the blocking means 7 have been unlocked and displaced under the action of the control surfaces 8 which have pivoted following arrow f2 around the shaft 19 to move from the folded position inside the seat 1 (FIG. 5) to a deployed position entirely outside the seat 1 and thus outside the projectile. The means to join a control surface 8 to its control shaft 80 is constituted by an arm 82 integral with the control surface and mounted able to rotate with respect to the shaft 19. The control surface 8 thus pivots around the shaft 19. A torsion spring 34 is provided around this axis to exert a torque on the arm 82 of the control surface 8 following arrow f2. This torque namely allows the blocking means 7 to be displaced and the control surfaces 8 to be deployed as soon as the blocking means have been unlocked. A pin 13 integral with the support 81 is pushed by a return spring (not shown). This pin 13 cooperates with a drill hole 12 made in the arm 82 to join the control surface 8 and the support 81 in the deployed position, the support being integral with the control surface shaft 80 as indicated previously. Thus, when released, the control surface pivots around the shaft 19 and comes to be positioned as shown in FIG. 6. At the end of its rotation, the control surface is immobilized by the pin 13 which penetrates inside drill hole 12.

The device operates as follows: after the deployment of the control surfaces has been validated (for example by an electronic system allowing the deployment of the control surfaces when the projectile has reached a certain velocity, or using a timer) the motors 2 are activated in rotation. The control surfaces 8, blocked in the folded position in the seat 1 prevent any rotation of their support 81 consequently immobilizing the shafts 80, the rods 6, the levers 5 and the shafts 21 of each motor. It is thus the body 20 of the motors 2 which pivots on its bearings 3 driving the rings 4 in rotation until each notch 40 lies opposite a finger 9. Fingers 9 thereafter translate under the action of the springs 10 and are inserted in the notches 40 in the rings 4 simultaneously releasing the blocking means 7.

The control surface 8 push the blocking means 7 and are thus able to deploy in the way described previously. The body 20 of the motors 2 is made integral with the seat 1 by fingers 9 whose nipple 92 is insterted into the notch 40 in the ring 4 thereby preventing the motor body 20 from rotating. When a motor 2 is activated, it is thus only its shaft which starts to move. The rotation of shaft 21 makes the rod 6 translate by means of the lever 5 therby causing the drive shaft 80 to rotate thus enabling the pair of control surfaces integral with the drive shaft to be oriented. For the improved operation of the device, the rod 6 will, for example, be connected to lever 5 and to shaft 80 by ball and socket type linking means.

What is claimed is:

1. A deployment and orientation device for control surfaces for a projectile, said device, comprising:

springs means for deploying said control surfaces from a loaded position in which said control surfaces are folded inside a projectile, to a deployed position in which said control surfaces extend externally from a projectile;

a pair of motors each having a shaft rotatably supported in a motor body, which motor body is capable of rotation about its longitudinal axis for acting in combination with said spring means to deploy said control surfaces;

blocking means for immobilizing said control surfaces and releasing them simultaneously; and first locking means for holding and releasing said blocking means from an immobilizing position by rotating the bodies of said motors.

2. The device according to claim 1, said first locking means comprising fingers activated by a spring and cooperating with a ring integral with the body of each motor.

3. The device according to claim 2, each ring has a notch for receiving an end of one of said fingers, wherein the displacement of all of said fingers releases said blocking means and prevents the rotation of said bodies of said motors.

4. The device according to claim 1, wherein two of said control surfaces are connected to a control shaft to be located transverse to a projectile, said motors for rotating each shaft.

5. The device according to claim 4, said motor connected to said control shaft with a lever for acting on a rod connected to said shaft.

6. The device according to claim 4, each said projectile control surfaces are connected to said control shaft with a support and an arm articulated with respect to said support.

7. The device according to claim 6, further comprising a spring for acting upon said arm to rotate each of said projectile control surfaces with respect to said support.

8. The device according to claim 7, further comprising second locking means for locking said projectile control surfaces and said support in said deployed position.

9. The device according to claim 8, said second locking means comprising a pin positioned in a drill hole in each of said projectile control surfaces for connecting each of said projectile control surfaces with said support.

* * * * *